United States Patent [19]

Kobayashi

[11] Patent Number: 4,699,383

[45] Date of Patent: Oct. 13, 1987

[54] CLUB-HEAD

[75] Inventor: Masashi Kobayashi, Matsudo, Japan

[73] Assignee: Maruman Golf Co., Ltd., Tokyo, Japan

[21] Appl. No.: 840,795

[22] Filed: Mar. 18, 1986

[30] Foreign Application Priority Data

Mar. 28, 1985 [JP] Japan ..... 60-62133

[51] Int. Cl.[4] ..... A63B 53/04

[52] U.S. Cl. ..... 273/169; 273/173

[58] Field of Search ..... 273/169, 174, 167 F, 273/173, 171, 170, 172, 175

[56] References Cited

U.S. PATENT DOCUMENTS

| | | | |
|---|---|---|---|
| 1,473,528 | 11/1923 | Tootle | 273/169 |
| 1,780,625 | 11/1930 | Mattern | 273/169 |
| 1,988,043 | 1/1935 | Lard | 273/169 |
| 3,640,534 | 2/1972 | Mills | 273/174 X |
| 4,063,737 | 12/1977 | Tom et al. | 273/174 |
| 4,540,178 | 9/1985 | Johnson et al. | 273/169 |
| 4,630,827 | 12/1986 | Yoneyama | 273/169 |

FOREIGN PATENT DOCUMENTS

| | | | |
|---|---|---|---|
| 59-16670 | 2/1984 | Japan | 273/169 |

*Primary Examiner*—George J. Marlo

*Attorney, Agent, or Firm*—Armstrong, Nikaido, Marmelstein & Kubovcik

[57] ABSTRACT

A club-head (10) for an iron golf club comprising a hitting portion constituted by a main body (11) made of fiber-reinforced plastic and a sole member (12) including a rib (15) made of metal, in which a plate-like back member (16) made of a heavy material such as a heavy metal is added to the main body (11) along or near the backside surface of the main body (11). This allows an improvement in the disposition of the center of gravity of the club-head and provides a wide selection of golf clubs suitable for the respective golfer.

3 Claims, 9 Drawing Figures

CLUB-HEAD

BACKGROUND OF THE INVENTION

1. Field of the Invention

The present invention relates to a head for a golf club, particularly to an improvement of a club-head, made of fiber-reinforced plastic, for an iron golf club.

2. Description of the Related Arts

Recently, an iron club-head has been widely used comprising a metal core body molded together with a sole exposed from underside of the club-head and an outer shell enveloping the core body and made of plastic reinforced by fibers such as carbon fiber or glass fiber. Generally speaking, the hitting characteristics tend to delicately vary in a club-head of this type, depending on the position of the center of gravity of the club-head in either the height direction or in the thickness direction. Therefore, it has long been desired to provide a wide selection of golf clubs, by which the golfer is provided with a club with a head in which the position of the center of gravity thereof can be made suitable for the respective golfer. In the known club-head, however, variations of the position of the center of gravity in the height and thickness direction are limited to a certain extent, since the core body is integral with a sole molded of the same material as the core body.

SUMMARY OF THE INVENTION

Accordingly, it is an object of the present invention to eliminate the abovesaid drawbacks of the prior arts and provide a wide selection to golfers through a club having a head made mainly of fiber reinforced plastic.

The object of the present invention can be achieved by a club-head for a golf club, having a hitting portion comprising a main body made of fiber-reinforced plastic and a metal sole member integrally fixed to the main body along the underside of the main body, characterized in that a plate-like back member is fixed to the hitting portion substantially parallel to and close to a back side surface of the main body, the back member being of a heavy material and formed separately from the sole member.

Preferably, the sole member may be formed integrally with a neck member of the club-head.

The back member may be positioned in the interior of the main body so as to be covered by the main body, or may be attached on the back surface of the main body so as to be exposed outside the main body.

BRIEF DESCRIPTION OF THE DRAWINGS

Other and further objects and advantages of the present invention will be apparent from the following description with reference to the preferred embodiments illustrated in the drawings; wherein.

DESCRIPTION OF THE PREFERRED EMBODIMENTS

Figure 1:
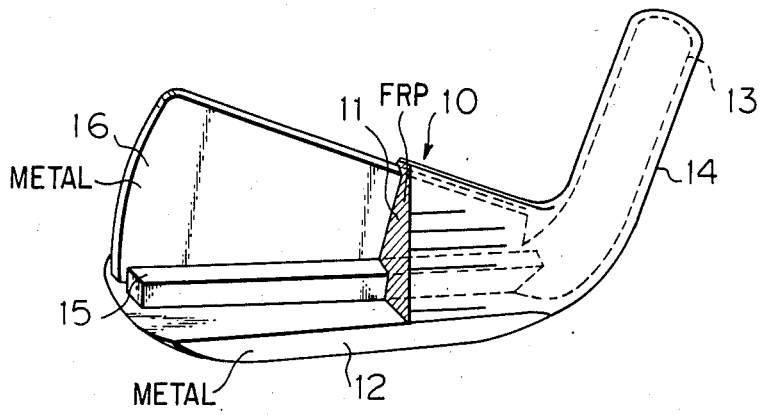
FIG. 1 is a partially broken perspective view of a club-head according to a first embodiment of the present invention.
Figure 2:
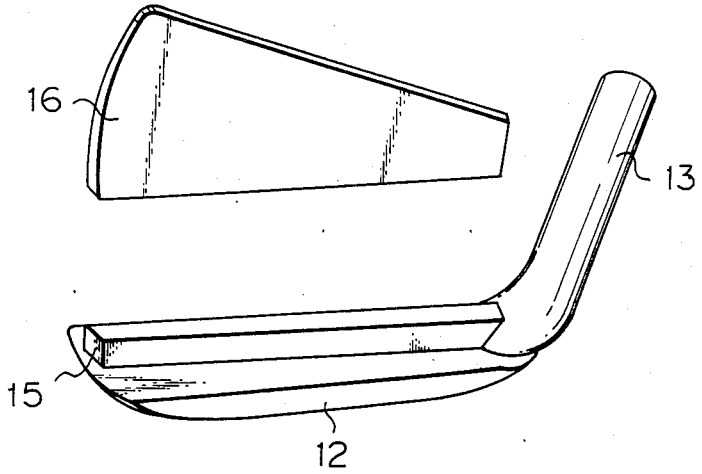
FIG. 2 is an exploded perspective view of the first embodiment illustrating a relationship between a sole member and a back member.
Figure 3:
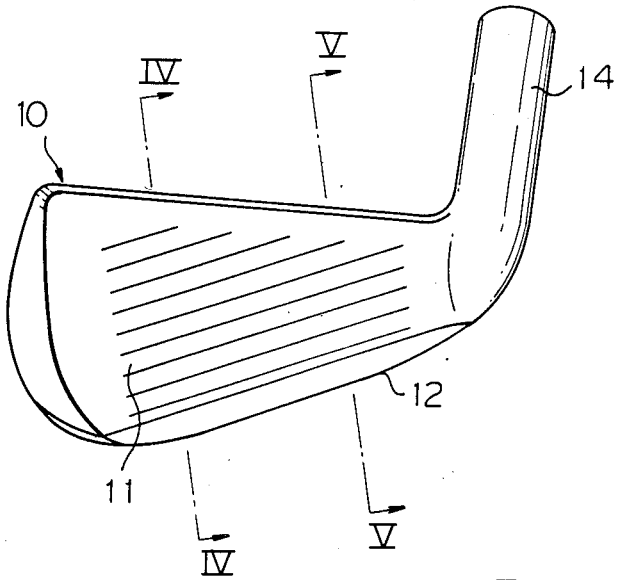
FIG. 3 is a perspective view of the club-head according to the first embodiment, illustrating an appearance thereof.
Figure 4:
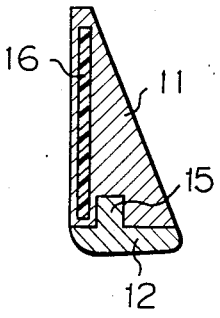
FIGS. 4 and 5 are sections taken along lines IV—IV and V—V of FIG. 3, respectively.
Figure 5:
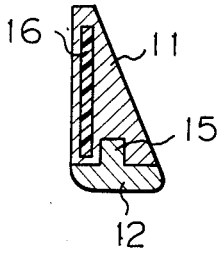

FIGS. 1 through 5 illustrate a first embodiment according to the present invention applied to a club-head 10 for an iron golf club. As apparent from the drawings, the club-head 10 comprises a main body 11 made of a fiber reinforced plastic, such as a plastic reinforced by carbon fibers or glass fibers, and constituting a hitting portion of the club-head. The plastic composing the main body 11 may be mixed with whiskers and/or an amorphous alloy to further improve the strength thereof.

A sole member 12 extending from a heel to a toe of the club-head is fixed to the main body 11 along the underside thereof. The sole member 12 is made of a metal such as stainless steel, iron, brass, aluminum alloy, or titanium alloy.

In this embodiment, the sole member 12 is formed integrally with a neck member 13 which, in turn, is enveloped by a cover 14 of the same fiber-reinforced plastic as that of the main body 11. A rib 15 is provided in the lengthwise direction on the upperside of the sole member 12 to ensure a tight connection between the main body 11 and the sole member 12.

A plate-like back member 16 is fixedly located within the main body 11 in the vicinity of the backside surface of the main body 11 and is covered thereby. The back member 16 is prepared separately from the sole member 12, and is a heavy material such as stainless steel, iron, brass, lead, or plastic mixed with a metal powder.

According to the club-head thus described, the position of the center of gravity can be defined in any place in the club-head, even in the height direction and in the thickness direction, by a selection of combinations of the material composing the sole member 12 and back member 16, having various specific weights. Further, the center of gravity of the club-head also can be easily adjusted in the thickness direction by varying the distance of the position of the back member 16 from the backside surface of the main body 11 during the molding of the club-head 10. The back member 16 also has another function of protecting the main body 11 of fiber-reinforced plastic from breakage upon impact of a golf ball, since the back member 16 of the heavy weight can absorb the momentum of the ball.

Figure 6:
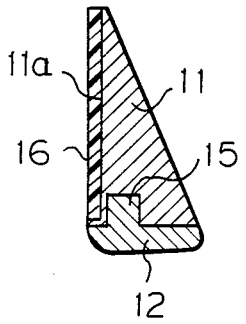
FIGS. 6 and 7 are sections of a club-head according to a second embodiment, corresponding to FIGS. 4 and 5, respectively.
Figure 7:
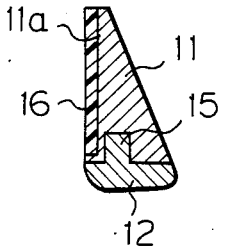

FIGS. 6 and 7 illustrate a second embodiment of the present invention, in which the same reference numerals are used for indicating the same or corresponding parts. In this embodiment, a back member 16 is secured in a recess 11*a* provided on the backside surface of the main body 11 by a suitable means such as an adhesive. Thus, the back member 16 is exposed outside the main body 11.

Figure 8:
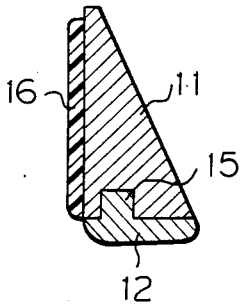
FIGS. 8 and 9 are sections of a club-head according to a third embodiment, corresponding to FIGS. 4 and 5, respectively.
Figure 9:
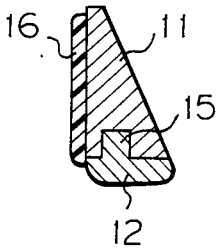

FIGS. 8 and 9 illustrate a third embodiment of the present invention, in which the same reference numerals are again used as in the preceding drawings. The difference between this embodiment and the second embodiment lies in the elimination of the recess ll*a* for securing the back member 16. Instead, the back member 16 is directly fixed to the backside surface of the main body 11. According to the third embodiment, the center of gravity of the club-head 10 can be most deviated to the backside of the main body 11.

As apparent from the above description, the club-head according to the present invention can adopt any combination of a sole member and a back member made of materials having a different specific weight, and the position of the back member can be easily adjusted during the design and manufacture of the club-head, whereby the position of the center of gravity thereof can be largely variable, which provides a wide selection of golf clubs to golfers.

While particular embodiments and applications of the present invention have been shown, it will be understood, of course, that the present invention is not limited thereto, since modifications can be made by those skilled in the art in the light of the foregoing teachings. For example, more than one rib 15 of the sole member 12 may be provided, or, instead of a rib, a groove or grooves may be provided. Further, the present invention may be applied to not only a club-head for an iron golf club, as in the foregoing embodiment, but also to other golf clubs, such as a putter.

Accordingly, the appended claims cover any such modifications which may incorporate those features which come within the true spirit and scope of the present invention.

I claim:

1. A club-head for a golf club including a hitting portion comprising a main body made of fiber-reinforced plastic and having a planar back side surface, a metal sole member integrally fixed to the main body along an underside of the main body, and a plate-like back member having a planar main surface and fixed to said hitting portion so that said planar main surface is substantially parallel to and close to said planar back side surface of said main body, said back member being made of heavy material and formed separately from said sole member, characterized in that said sole member is provided with a rib disposed in the lengthwise direction on an upperside of said sole member and is rigidly connected to a neck member of the club-head to form a one-piece member.

2. A club-head as defined by claim 1, wherein said back member is positioned in the interior of said main body so as to be covered by said main body.

3. A club-head as defined by claim 1, wherein said back member is attached on the back surface of said main body so as to be exposed outside said main body.

* * * * *